US006682374B2

(12) United States Patent
Kokubo

(10) Patent No.: US 6,682,374 B2
(45) Date of Patent: Jan. 27, 2004

(54) TILT SUPPORT MECHANISM FOR OUTBOARD MOTOR

(75) Inventor: Kouei Kokubo, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/166,488

(22) Filed: Jun. 10, 2002

(65) Prior Publication Data

US 2002/0193021 A1 Dec. 19, 2002

(30) Foreign Application Priority Data

Jun. 19, 2001 (JP) ..... 2001-184909

(51) Int. Cl.[7] ..... B63H 21/24
(52) U.S. Cl. ..... 440/53
(58) Field of Search ..... 440/53, 55, 63, 440/900

(56) References Cited

U.S. PATENT DOCUMENTS 4,419,083 A 12/1983 Taguchi
4,759,733 A * 7/1988 Nishimura ..... 440/55
5,509,836 A 4/1996 Ogasawara et al.
6,183,320 B1 2/2001 Natsume
6,309,265 B1 10/2001 Oguma

FOREIGN PATENT DOCUMENTS

JP 0140292 * 8/1982 ..... 440/53

* cited by examiner

*Primary Examiner*—Ed Swinehart
(74) *Attorney, Agent, or Firm*—Knobbe, Martens, Olson & Bear LLP

(57) ABSTRACT

An outboard motor includes a drive unit and a bracket assembly mounted on an associated watercraft. The bracket assembly includes a swivel bracket arranged to support the drive unit for pivotal movement through a steering angle about a steering axis. A clamping bracket is arranged to support the swivel bracket for pivotal movement about a tilt axis. The clamping bracket includes a pair of bracket arms spaced apart from each. Each bracket arm defines a plurality of openings that are arranged next to one another in an arcuate line so as to minimize a fore-to-aft width of the bracket arm. As a result of the smaller bracket arm width, the drive unit can be pivoted through a larger steering angle.

18 Claims, 5 Drawing Sheets

TILT SUPPORT MECHANISM FOR OUTBOARD MOTOR

PRIORITY INFORMATION

This application is based on and claims priority to Japanese Patent Application No. 2001-184909, filed Jun. 19, 2001, the entire contents of which is hereby

BACKGROUND OF THE INVENTION

1. Field of the Invention

The present invention relates generally to a tilt support mechanism for an outboard motor, and more particularly to an improved tilt support mechanism to hold a drive unit of an outboard motor at any position higher than a fully tilt down position.

2. Description of Related Art

An outboard motor typically has a bracket assembly to support its drive unit on an associated watercraft. The bracket assembly comprises a clamping bracket formed by a pair of bracket arms that are spaced apart from each other and a swivel bracket interposed between the bracket arms. The swivel bracket supports the drive unit for pivotal movement about a generally vertically extending steering axis. The bracket arms are mounted on a transom of the watercraft. A generally horizontally extending pivot pin forms a hinge coupling between the swivel bracket and the clamping bracket such that clamping bracket supports the swivel bracket for pivotal movement about a tilt axis of the pivot pin. Thus, the swivel bracket together with the drive unit can pivotally move between a fully tilted down position and a fully tilted up position.

Normally, the drive unit in the fully tilted down position can place a propulsion device, such as, for example, a propeller, in a submerged position with the watercraft resting on the surface of a body of water. In the fully tilted up position the orientation of the drive unit places the propulsion device above the body of water when the watercraft is moored. The drive unit can take any position between the fully tilted down position and the fully tilted up position, either to adjust the trim angle of the watercraft or to slightly raise the propulsion device when the watercraft travels through shallow waters.

A tilt support mechanism can be provided to support the swivel bracket and the drive unit at a desired tilt position. In order to form the tilt support mechanism, the clamping bracket defines a plurality of pairs of openings in the bracket arms and a tilt pin transversely extends through one of pairs of the openings. The tilt pin sets the lowermost position of the swivel bracket when the swivel bracket rests against the tilt pin.

For example, FIG. 1 illustrates an arrangement of the tilt support mechanism 10. The bracket arms 12 include five pairs of openings 14 and a tilt pin 16 extends transversely through one of the pairs of the openings 14. In the illustrated case, the tilt pin 16 extends through the pair of openings positioned second from the bottom. The swivel bracket 18 rests on the tilt pin 16. Each hole 14 of a pair of openings is directly aligned with the corresponding hole 14 in the other bracket arm 12.

In this arrangement, however, the bracket arms 12 include rear ends 20 that protrude toward a drive unit 22 in order to accommodate the array of openings 14. This protrusion necessarily limits an angle range for steering the drive unit. This problem becomes exacerbated with drive units having larger girths. For instance, outboard motors provided with a four-cycle engine often have a large volume lubricant reservoir disposed in the drive unit 22. The drive unit 22 consequently has a larger girth which limits the range of angular steering movement when used with the prior bracket assembly. In such case, the resulting interference between the rear ends 20 of the bracket arms 12 and the larger girth drive unit 22 limit the angular steering range of the outboard motor.

SUMMARY OF THE INVENTION

One aspect of the present invention involves a tilt support mechanism for an outboard motor that allows an associated drive unit of the outboard motor, which has a relatively large girth, to pivot through a large steering angle. The tilt support mechanism can also be used with smaller girth drive units to enhance further the range of steering movement of the outboard motor.

In accordance with one aspect of the present invention, an outboard motor comprises a drive unit and a bracket assembly adapted to be mounted on an associated watercraft. The bracket assembly comprises a swivel bracket arranged to support the drive unit for pivotal movement about a steering axis. A clamping bracket is arranged to support the swivel bracket for pivotal movement about a generally tilt axis that extends generally normal to the steering axis. The clamping bracket comprises a pair of bracket arms spaced apart from each other so that at least a portion of the swivel bracket can fit between the bracket arms. Each bracket arm defines a plurality of openings that are arranged next to one another along an arcuate line. The openings of one bracket arm generally align with the openings of the other bracket arm to form opposing pairs of openings. A tilt pin extends transversely through one of the opposing pairs of openings and is capable of being selectively removed therefrom and inserted into another opposing pair of openings. The tilt pin is arranged to limit movement of the swivel bracket between the bracket arms.

Another aspect of the present invention involves an outboard motor comprising a drive unit and a bracket assembly adapted to be mounted on an associated watercraft. The bracket assembly comprises a swivel bracket arranged to support the drive unit for pivotal movement about a steering axis. A clamping bracket arranged to support the swivel bracket for pivotal movement about a tilt axis that extends generally normal to the steering axis. The clamping bracket comprises a pair of bracket arms spaced apart from each other so that at least a portion of the swivel bracket can fit between the bracket arms. Each bracket arm defines a plurality of pin openings. A tilt pin is sized to fit within the pin openings on each bracket arm. All of the pin openings on each bracket arm are arranged in a single line next to one another and at least one of the pin openings on each bracket arm being positioned farther forward and higher than an adjacent pin opening.

Further aspects, features and advantages of the invention will become apparent from the detailed description of the preferred embodiment which follows.

BRIEF DESCRIPTION OF THE DRAWINGS

As noted above.

DETAILED DESCRIPTION OF THE PREFERRED EMBODIMENT

Figure 2:
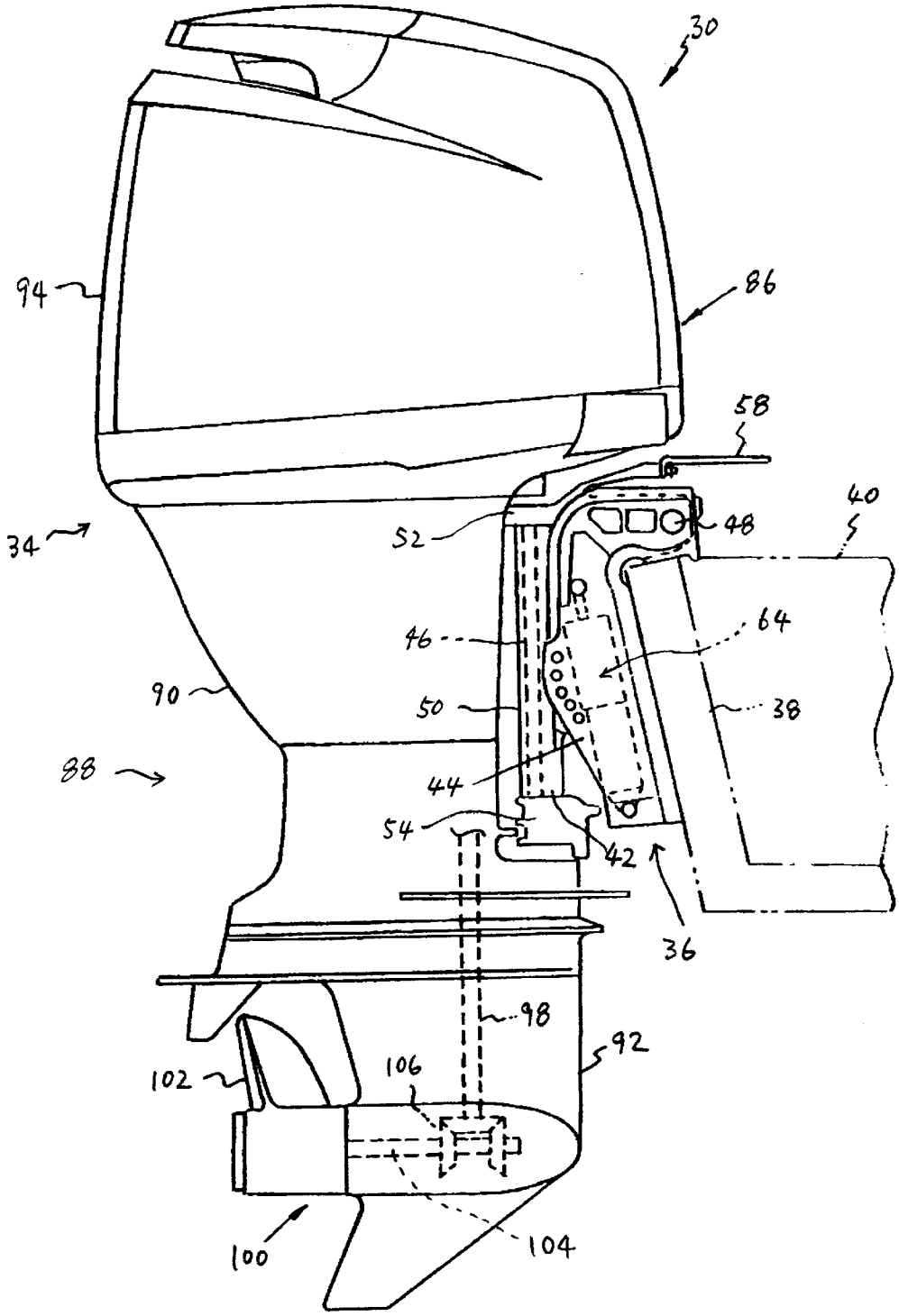
FIG. 2 is a side elevational view of an outboard motor configured in accordance with a preferred embodiment of the present invention. An associated watercraft is illustrated in phantom.
Figure 3:
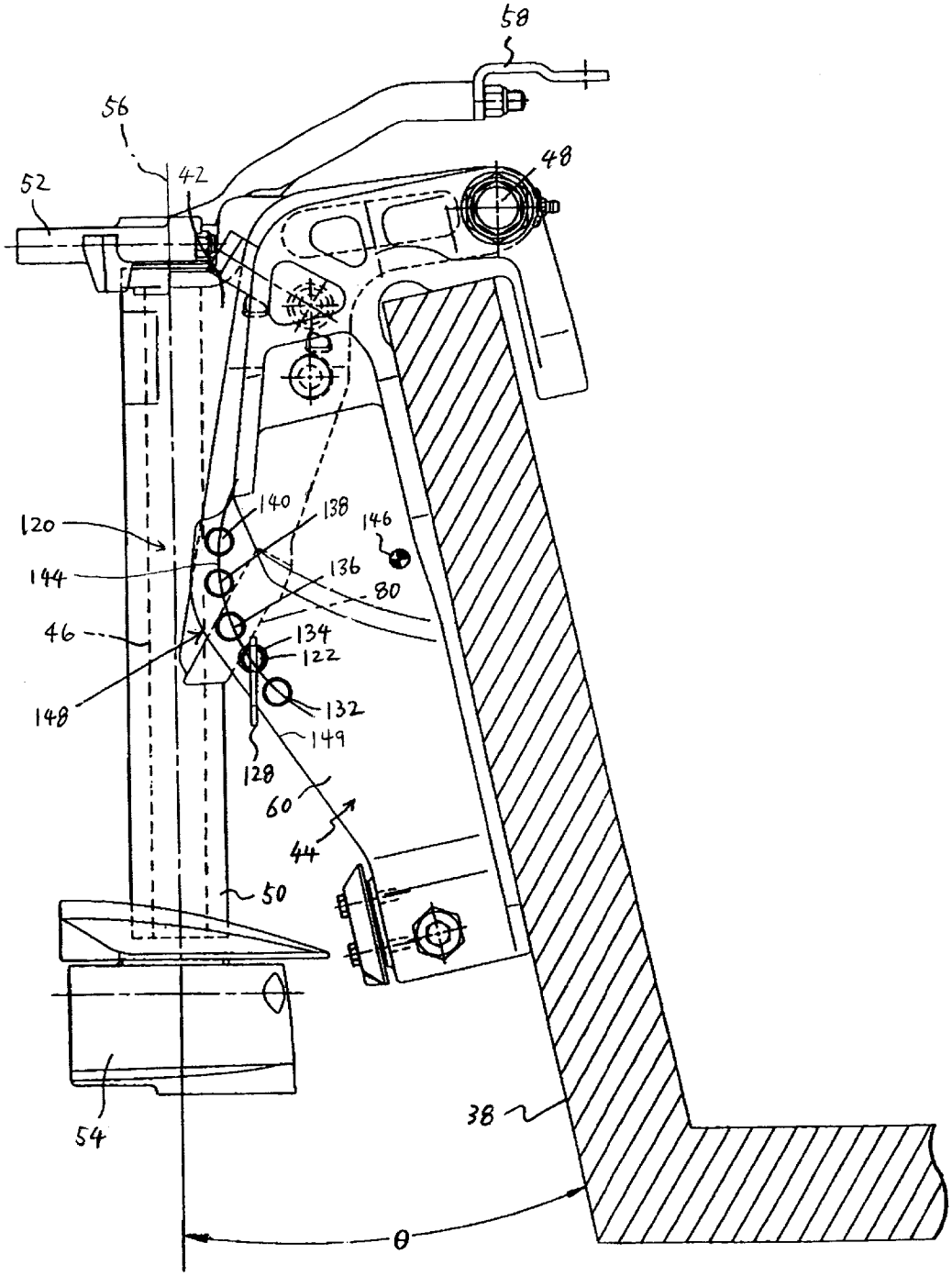
FIG. 3 is a side elevational view of a bracket assembly of the outboard motor shown in FIG. 2, showing a tilt support mechanism thereof.
Figure 4:
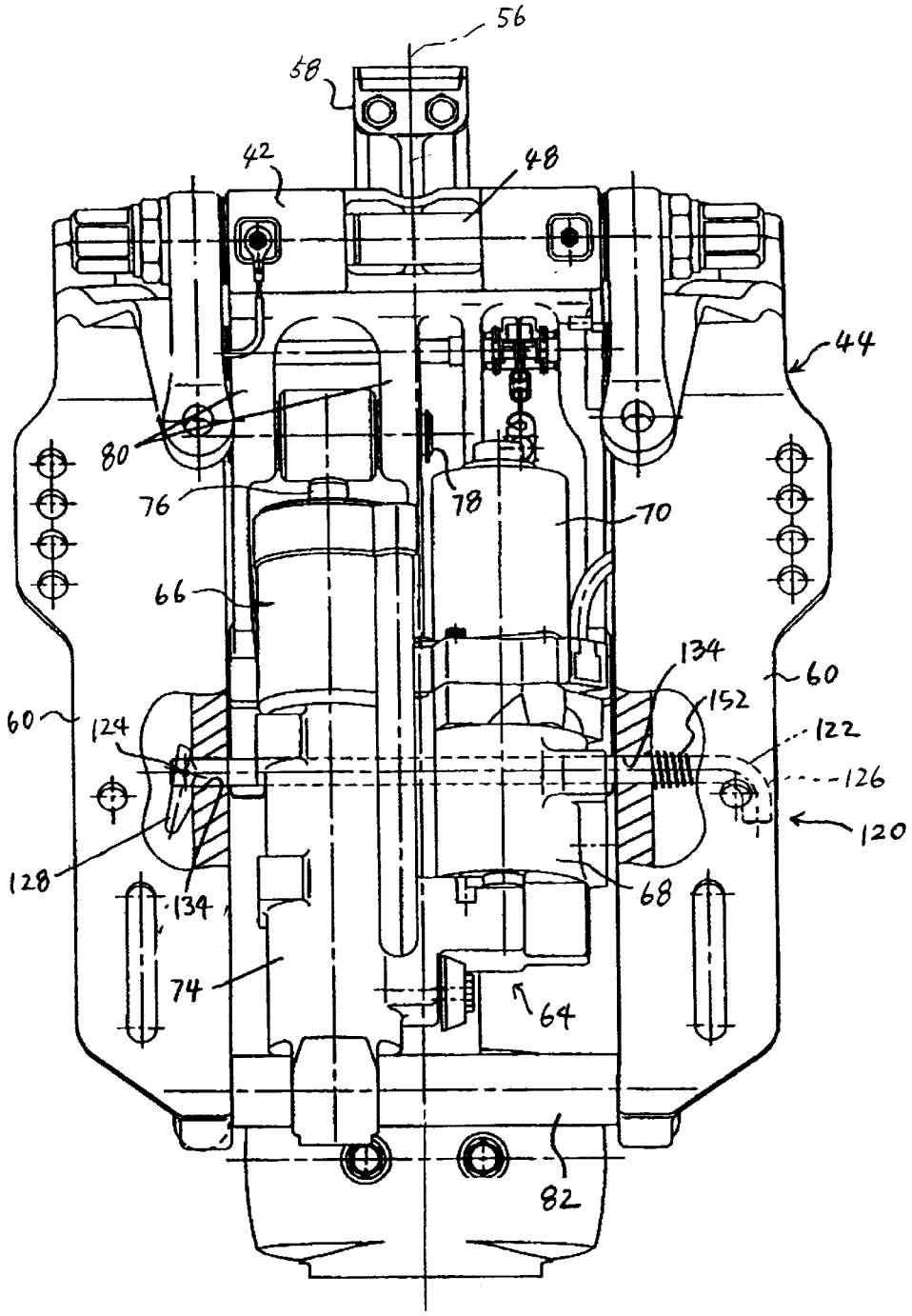
FIG. 4 is a front view of the bracket assembly of FIG. 3.

With reference to FIGS. 2–4, an overall construction of an outboard motor 30 configured in accordance with certain features, aspects and advantages of the present invention will be described.

In the illustrated arrangement, the outboard motor 30 comprises a drive unit 34 and a bracket assembly 36. The bracket assembly 36 supports the drive unit 34 on a transom 38 of an associated watercraft 40 and places a marine propulsion device in a submerged position with the watercraft 40 resting on the surface of a body of water. The bracket assembly 36 preferably comprises a swivel bracket 42, a clamping bracket 44, a steering shaft 46 and a pivot pin 48.

The steering shaft 46 typically extends through a steering post 50 of the swivel bracket 42 and is affixed to the drive unit 34 by upper and lower mount assemblies 52, 54. The steering shaft 46 is pivotally journaled for steering movement about a generally vertically extending steering axis 56 that is defined by the steering shaft 46. A steering handle 58 extends forwardly atop the steering shaft 46 so that the operator can operate the steering shaft 46, either manually or remotely via a steering system of the watercraft that is coupled to a steering arm attached to the steering shaft.

The clamping bracket 44 comprises a pair of bracket arms 60 (FIGS. 3 and 4) spaced apart from each other. The pivot pin 48 extends between and preferably holds together the upper ends of the respective bracket arms 60. The bracket arms 60 are spaced apart so as to receive at least an upper portion of the swivel bracket 42. The top of each bracket arm 60 is formed as a hook and is fitted over the top of the watercraft transom 38. The pivot pin 48 also completes a hinge coupling between the swivel bracket 42 and the clamping bracket 44. The pivot pin 48 transversely extends through the bracket arms 60 and the upper portion of the swivel bracket 42 so that the clamping bracket 44 supports the swivel bracket 42 for pivotal movement about a generally horizontally extending tilt axis that is defined by the pivot pin 48. The drive unit 34 thus can be tilted about the tilt axis.

As used throughout this description, the terms "forward", "forwardly" and "front" mean at or to the side where the bracket assembly 36 is located, and the terms "rear," "reverse," "backwardly" and "rearwardly" mean at or to the opposite side of the front side, unless indicated otherwise or otherwise readily apparent from the context in which the term is used. In addition, the term "tilt movement," when used in a broad sense, typically includes both tilt movement and trim adjustment movement of the outboard motor. Thus, as used throughout this description, the term "tilt movement" is used in accordance with this broad meaning, unless the trim adjustment movement is specifically mentioned. Similarly, the term "tilt" means both tilt and trim adjustment.

With particular reference to FIG. 4, a hydraulic tilt and trim adjustment system 64 preferably is provided between the swivel bracket 42 and the clamping bracket 44 to tilt (raise or lower) the swivel bracket 42 and the drive unit 34 relative to the clamping bracket 44. The tilt system 64 generally nests between the respective bracket arms 60.

The hydraulic tilt system 64 preferably comprises a hydraulic cylinder unit 66, a fluid pump 68 and an electric motor 70, which are unitarily formed together in the illustrated embodiment. The cylinder unit 66 is disposed on the starboard side or right side (left side of FIG. 4) relative to a center plane of the outboard motor 30. The center plane extends generally vertically and includes the steering axis 56. The pump 68 and the electric motor 70 are oppositely disposed on the port side or left side (right side of FIG. 4) relative to the center plane.

The cylinder unit 66 comprises a cylinder body 74 containing working fluid and a piston slideably moveable within the cylinder body 74. The piston and the cylinder body 74 together define upper and lower chambers in the cylinder unit 66. A piston rod 76 is affixed to the piston and extends beyond an upper end of the cylinder body 74 in the illustrated embodiment. A lower end of the cylinder body 74 is closed. The fluid pump 68 is connected to both the upper and lower chambers and pressurizes the working fluid to move the piston within the cylinder body 74. The electric motor 70 can drive the fluid pump 68 in forward and reverse directions. Thus, the piston rod 76 can either extend outwardly from the cylinder body 74 or retract inwardly into the cylinder body 74 with the pump 68 driven by the motor 70 in the forward and reverse directions, respectively.

The piston rod 76 has an upper mount shaft 78 which is journaled by a pair of mount bosses 80 of the swivel bracket 42 for pivotal movement. A boss of the piston rod 76 interposes the mount bosses 80. The cylinder body 74 has a lower mount shaft 82 which is journaled by the respective bracket arms 60 of the clamping bracket 44. Accordingly, with the extension or retraction of the piston rod 76, the swivel bracket 42, together with the drive unit 34, can move between the filly tilted down position and the filly tilted up position.

Alternatively, a manually operated tilt system can replace the hydraulic tilt system 64. However, using the hydraulic tilt system 64 is extremely helpful in connection with a large sized outboard motor.

With reference to FIG. 2, the illustrated drive unit 34 comprises a power head 86 and a housing unit 88 which includes a driveshaft housing 90 and a lower unit 92. The power head 86 is disposed atop the drive unit 34 and houses an internal combustion engine (not shown) within a protective cowling 94. The protective cowling 94 preferably comprises a bottom cowling member and a top cowling member that is detachable from the bottom cowling member. The engine in the illustrated arrangement preferably operates on a four-cycle combustion principle and employs a closed-loop, dry sump lubrication system. This engine type, however, merely exemplifies one type of outboard motor in connection with which the present tilt support mechanism can be used. The present tilt support mechanism can be used with outboard motors having engines that operate on other combustion principles (e.g., two-stroke, rotary) and that have other types of lubrication systems (e.g., a crankcase-injected lubricant system).

The driveshaft housing 90 depends from the power head 86 and the lower unit 92 depends from the driveshaft housing 90. A driveshaft 98 extends generally vertically through the driveshaft housing 90 and the lower unit 92. The drive shaft 98 is coupled with a crankshaft of the engine to be driven thereby. The driveshaft housing 90 contains a lubricant reservoir (not shown) of the lubrication system in an upper area of the housing 90. The lubricant reservoir occupies a relatively large space of the upper area.

The lower unit 92 carries a propulsion device 100. In the illustrated arrangement, the propulsion device 100 includes a propeller 102 which is affixed to a propulsion shaft 104 that extends generally horizontally within the lower unit 92. A transmission 106 preferably is provided between the driveshaft 98 and the propulsion shaft 104. The transmission 106 couples together the two shafts 98, 104 which lie generally normal to each other (i.e., at a 90° shaft angle), with bevel gears. The propulsion shaft 104 thus is driven by the driveshaft 98 through the transmission 106 to rotate the propeller 102. The transmission 106 can include a clutch mechanism to change the rotational direction of the propeller 102 among forward, neutral or reverse. The propulsion device can take the form of a dual counter-rotating system, a hydrodynamic jet, or any of a number of other suitable propulsion devices.

With particular reference to FIGS. 3 and 4, a tilt support mechanism 120 configured in accordance with the present invention will now be described. The illustrated hydraulic tilt system 64 can hold the swivel bracket 42 and the drive unit 34 at any position between the fully tilted down position and the fully tilted up position. However, the drive unit will exert a large force on the hydraulic tilt system 64, which acts against the piston rod 76, when the outboard motor propels the watercraft forward with high thrust. This places a great burden on the tilt system 64. In order to release the tilt system 64 from always holding the swivel bracket 42 and the drive unit 34 at a desired position, the tilt support mechanism 120 has a tilt pin 122 extending transversely against which the swivel bracket 42 can abut or act against. The tilt pin 122 establishes a lowermost position of the swivel bracket 42 and supports the swivel bracket 42 at this position unless the tilt system 64 lifts the swivel bracket 42 to a higher position.

As best seen in FIG. 4, the tilt pin 122 preferably is a circular bar having a longitudinal pin axis and a hook-like end 126. At its opposite end, the tilt pin 122 includes an engaging arm 128 that is pivotally attached. The engaging arm 128 can swing or pivot about a transverse pin axis 124 that extends generally normal to the longitudinal pin axis. The engaging arm 128, which in the illustrated embodiment has a generally triangular shape, thus can extend generally straight along the longitudinal pin axis 124 or can be pivoted about the transverse pin axis 124 to project transversely (e.g., vertically with the tilt pin oriented in the position shown in FIG. 4) from the circular bar.

Each bracket arm 60 defines a plurality of openings (i.e., pin openings) that extend between inner and outer side surfaces of the bracket arm. The openings in each bracket arm 60 are arranged next to one another along an arcuate line that extends somewhat vertically, as best shown in FIG. 3. More specifically, the respective centers of the openings are on the arcuate line. In the illustrated arrangement, five openings 132, 134, 136, 138, 140 are defined from bottom to top. The openings 132, 134, 136, 138, 140 form pairs with corresponding opening in the other bracket arm. That is, respective openings in the bracket arms align with each other to form an opposing pair of openings. The bracket arms, in the illustrated embodiment, thus form five pairs opposing pairs of openings.

In the embodiment illustrated in FIG. 3, the arcuate line, along which the openings of each bracket arm 60 are arranged, is an arc 144, preferably of a substantially constant radius. However, the arcuate line can have other shapes as well.

The illustrated arc 144 extends about a center 146 that is disposed farther from the drive unit 34 than the openings 132, 134, 136, 138, 140 and closer to the watercraft transom 38. The center 146 of the arc preferably is positioned lower than the center of the uppermost opening 140 and higher than the center of the lowermost opening 132. In addition, at least the uppermost opening 140 preferably is positioned slightly more forward than the adjacent opening 138. The opening 138 can take a similar position with respect to the next lower opening 136 in the same relationship as such described, although the openings 138 and 136 in the illustrated arrangement are not in this relationship.

Each bracket arm 60 defines a rear outer surface 148 that forms an edge 149 at an intersection with the outer side surface of the bracket arm 60. At least the edge 149, and preferably the entire rear outer surface 148, extends generally along the arc 144. That is, the outer edge 149 generally forms another arc at least in an area adjacent to the openings 132, 134, 136, 138, 140 and a center of this second arc preferably coincides with the center 146 of the first arc 144. This preferred shape of the rear outer surface 148 minimizes the fore-to-aft width of the bracket arm 60 while providing sufficient area at which to locate the openings.

The arcuate line along which the openings are spaced can be part of an ellipse or oval, rather than be an arc length of a circle as illustrated. Other arcuate lines which are formed, for example, in combining portions of two or more circles or ellipses also can be used. In the latter variation, the arcuate line can have one or more center points. The center points preferably are disposed lower than the top opening 140 and higher than the bottom opening 132.

The outer surfaces 148 do not protrude farther rearward than the position of the steering axis 56. In other words, rear ends of the bracket arms 60 are disposed in front of the steering axis 56.

The tilt pin 122 transversely extends through one pair of the openings 132, 134, 136, 138, 140. In this illustrated arrangement, the pair of openings 134 located second from the bottom is selected. When inserting the tilt pin 122, the engaging arm 128 is set to extend straight along the longitudinal pin axis. As seen in FIG. 4, the pin 122 is first inserted into the opening 134 on the port side and then into the opening 134 on the starboard side with a spring 152 interposed between the hook-like end 126 and the bracket arm 60 on the port side. The engaging arm 128 thence swings down under its own weight and engages the bracket arm 60 on the starboard side because the spring 152 urges the tilt pin 122 toward the port side (to the right side of FIG. 4). The engaging arm 128 thereby can prevent the tilt pin 122 from slipping out from the openings 134. On the other hand, with the tilt pin 122 pushed toward the starboard side against the biasing force of the spring 152, the engaging arm 128 is easily disengaged from the bracket arm 60 and the tilt pin 122 can be slid out the openings 134.

The operator can select any one of the pairs of the openings 132, 134, 136, 138, 140 in accordance with a tilt position or tilt angle θ (FIG. 3) which the operator desires. If the selected pair of the openings 132, 134, 136, 138, 140 is not appropriate, the operator can of course change the position of the tilt pin 122. The tilt angle θ is defined as an angle between the watercraft transom 38 and the steering axis 56. In general, a transom of a watercraft slants rearwardly relative to a true vertical line when the watercraft rested on the water surface. The transom 38 in the illustrated arrangement slants twelve (12) degrees from perpendicular. When the openings 134, which are located second from the bottom, are selected, the tilt angle θ is twelve (12) degrees and the steering axis 56 generally with true vertical (i.e., is generally perpendicular to the water surface). The illustrated openings 132, 134, 136, 138, 140 preferably are disposed at regular intervals, and more preferably at four (4) degree intervals. Thus, when the tilt pin 122 is positioned at the bottom openings 132, the tilt angle θ is eight (8) degrees. In the same manner, the tilt angles θ at the openings 136, 138, 140 are 16, 20 and 24 degrees, respectively.

In the illustrated arrangement, the outer surfaces 148 do not protrude rearwardly as described above. The illustrated tilt support mechanism 120 thus allows the drive unit 34 to be rotated through a relatively large angular range for steering without interfering with the bracket arms 60. In cases where the girth of the drive unit is less—for example with two-stroke outboard motors that do not include a lubrication reservoir in the drive unit—the configuration of the bracket arms further enhances the steering angle range through which the outboard motor can be swung.

Figure 1:
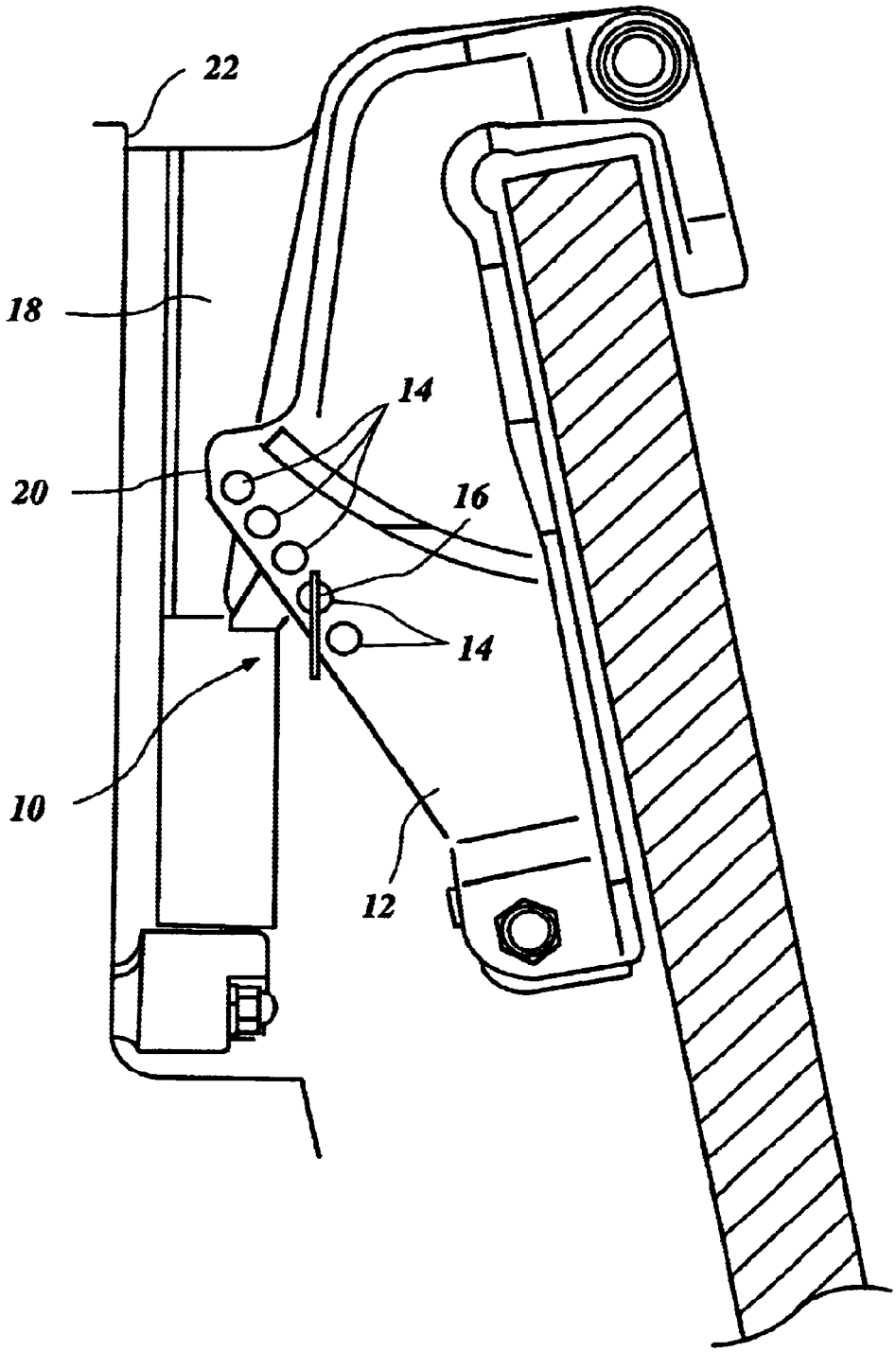
Figure 1 Prior Art
FIG. 1 is a side elevational view of a bracket assembly, showing a prior tilt support mechanism that has the above-noted drawbacks.
Figure 5:
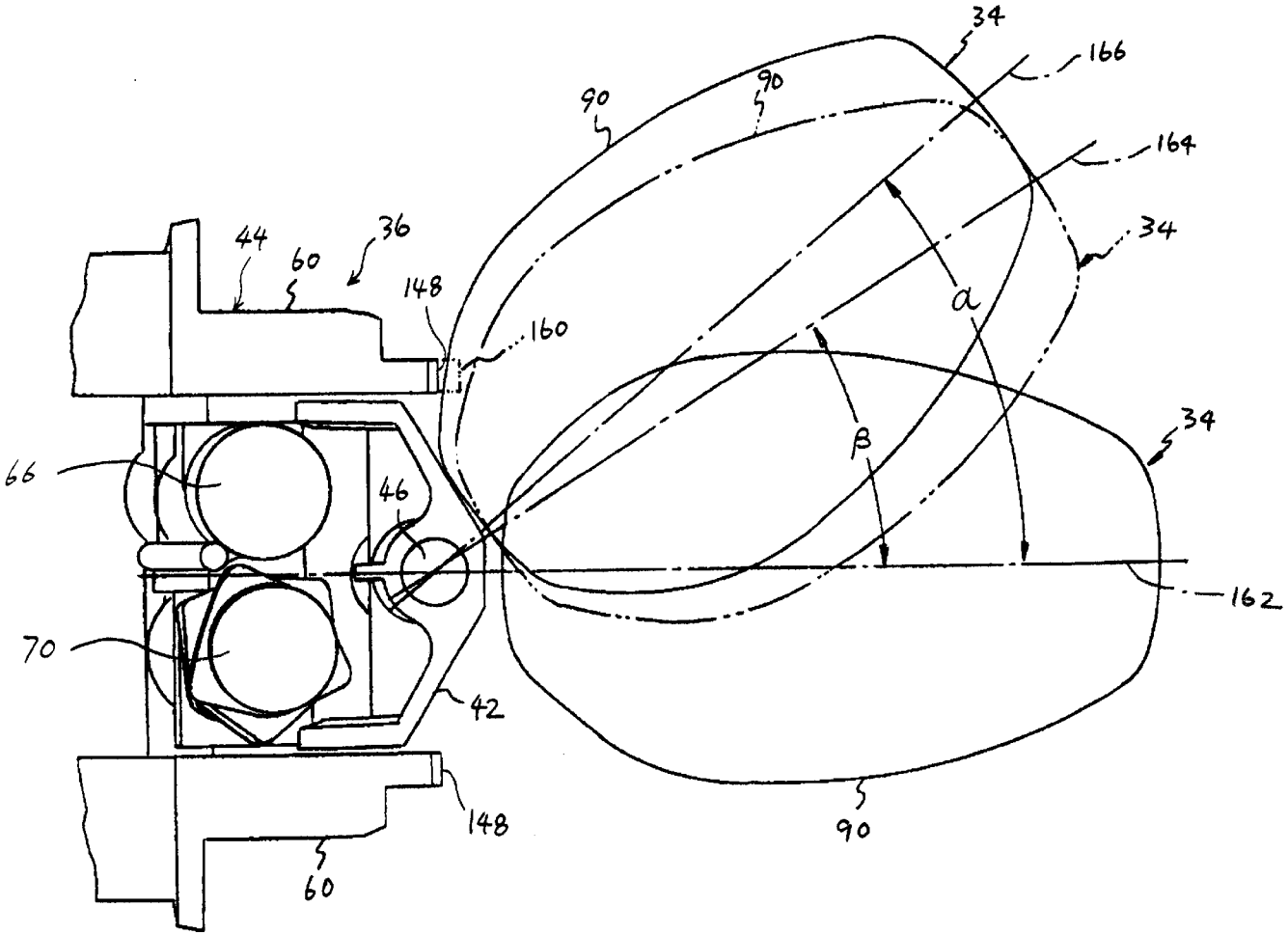
FIG. 5 is a schematical top plan view of the outboard motor shown in FIG. 2. A fully turned position and straight ahead position of a drive unit of the outboard motor are shown in solid lines. This figure also illustrates a portion of the bracket assembly shown in FIG. 1 in phantom and illustrates a fully turned position of a prior drive unit in phantom.

For instance, FIG. 5 illustrates that the driveshaft housing 90, which is supported by the present tilt support mechanism, can be rotated through a larger range of movement than if the driveshaft housing were supported by the prior support mechanism that is illustrated in FIG. 1 and includes rearward-protruding outer surfaces 160 (only the starboard side is shown in phantom). A center line 162 indicates a longitudinal axis of the driveshaft housing 90 when it is in a straight-ahead position. A second line 164 indicates the longitudinal axis of the driveshaft housing 90 when in fully steered position that is limited by the rearwardly-protruding outer surfaces 160 of the prior support mechanism. The angle β indicates the maximum steering angle range of the driveshaft housing 90 when supported by the prior support mechanism. The third line 166 indicates the longitudinal axis of the driveshaft housing 90 as supported by the present tilt support mechanism when in a fully steered position. The angle α indicates the maximum steering angle range of the driveshaft housing 90 under this condition. The angle α is larger than the angle β because the rear outer surfaces 148 or the bracket arms 60 protrude less than the prior bracket arms.

In the arrangement of the openings 132, 134, 136, 138, 140 along an arcuate line that bows toward the transom 38 of the watercraft, at least the upper openings 138, 140 are disposed closer to the transom than in the prior design illustrated in FIG. 1. Consequently, an operator can more easily operate the tilt pin 122 of the present tilt support mechanism from inside of the watercraft 40.

In addition, the point at which the swivel bracket 42 contacts the tilt pin 122 will vary as the location of the tilt pin 122 is moved among the opening pairings 132, 134, 136, 138, 140. For instance, the point of contact between the tilt pin 122 and the swivel bracket 42 with the tilt pin in the lowermost opening pair 132 is more to the rear side of the pin, while the point of contact between the tilt pin 122 and the swivel bracket 42 with the tilt pin in the uppermost opening pair 140 is more to the top side of the pin. This occurs because of the arcuate path along which the openings are arranged. In contrast, in the prior support mechanism shown in FIG. 1 in which the openings are arranged in a straight line, the point of contact between the tilt pin and the swivel bracket remains the same regardless into which hole the pin is inserted. The resulting varying points of contact between the pin and the swivel bracket in the present tilt support mechanism reduces frictional wear on the tilt pin and the swivel bracket.

Of course, the foregoing description is that of a preferred construction having certain features, aspects and advantages in accordance with the present invention. For instance, the number of the openings can vary. The tilt pin can take any other engaging configurations with the bracket arms. Accordingly, various changes and modifications may be made to the above-described arrangements without departing from the spirit and scope of the invention, as defined by the appended claims.

What is claimed is:

1. An outboard motor comprising a drive unit and a bracket assembly adapted to be mounted on an associated watercraft, the bracket assembly comprising a swivel bracket arranged to support the drive unit for pivotal movement about a steering axis, a clamping bracket arranged to support the swivel bracket for pivotal movement about a tilt axis that lies generally normal to the steering axis, the clamping bracket including a pair of bracket arms spaced apart from each other, each bracket arm defining a plurality of openings that are arranged next to one another along an arcuate line that extends in an arc having a substantially constant radius of curvature, the openings of one bracket arm generally aligning with the openings of the other bracket arm to form opposing pairs of openings, and a tilt pin extending transversely through one of the opposing pairs of openings, one of the openings of at least one bracket arm being positioned farther rearward than two adjacent openings between which said one opening is interposed along the arcuate line.

2. The outboard motor as set forth in claim 1, wherein a center of each arc is disposed farther from the drive unit than the corresponding openings.

3. The outboard motor as set forth in claim 1, wherein the openings are spaced apart uniformly along the corresponding arcuate line.

4. The outboard motor as set forth in claim 1, wherein each one of the bracket arms defines an outer surface with an edge that extends along a second generally arcuate line.

5. The outboard motor as set forth in claim 4, wherein the first and second arcuate lines have generally similar shapes.

6. The outboard motor as set forth in claim 5, wherein the second arcuate line extends in an arc having a substantially constant radius of curvature.

7. The outboard motor as set forth in claim 6, wherein a center of the arc of the second arcuate line generally coincides with a center of the arc of the first arcuate line.

8. The outboard motor as set forth in claim 1 additionally comprising a steering shaft defining the steering axis, a rear end of each bracket arm being positioned farther forward than the steering axis.

9. The outboard motor as set forth in claim 1, wherein each one of the bracket arm has a single set of the plurality of openings that are arranged along the arcuate line.

10. An outboard motor comprising a drive unit and a bracket assembly adapted to be mounted on an associated watercraft, the bracket assembly comprising a swivel bracket arranged to support the drive unit for pivotal movement about a steering axis, a clamping bracket arranged to support the swivel bracket for pivotal movement about a tilt axis that lies generally normal to the steering axis, the clamping bracket including a pair of bracket arms spaced apart from each other so that at least a portion of the swivel bracket can fit between the bracket arms, each bracket arm defining a plurality of openings that are arranged next to one another along an arcuate line that extends in an arc having a substantially constant radius of curvature, the center of each arc being located lower than at least a center point of one of the corresponding openings, the openings of one bracket arm generally aligning with the openings of the other bracket arm to form opposing pairs of openings, and a tilt pin extending transversely through one of the opposing pairs of openings and capable of being selectively removed therefrom and inserted into another opposing pair of openings, the tilt pin being arranged to limit movement of the swivel bracket between the bracket arms.

11. The outboard motor as set forth in claim 10, wherein the center of each arc is located higher than at least a center point of one of the corresponding openings.

12. The outboard motor as set forth in claim 10, wherein each one of the bracket arm has a single set of the plurality of openings that are arranged along the arcuate line.

13. The outboard motor as set forth in claim 10, wherein the openings are spaced apart uniformly along the corresponding arcuate line.

14. The outboard motor as set forth in claim 10, wherein each one of the bracket arms defines an outer surface with an edge that extends along a second generally arcuate line.

15. An outboard motor comprising a drive unit and a bracket assembly adapted to be mounted on an associated watercraft, the bracket assembly comprising a swivel bracket arranged to support the drive unit for pivotal movement about a steering axis, a clamping bracket arranged to support the swivel bracket for pivotal movement about a tilt axis that extends generally normal to the steering axis, the clamping bracket including a pair of bracket arms spaced apart from each other so that at least a portion of the swivel bracket can fit between the bracket arms, each bracket arm defining a plurality of pin openings, and a tilt pin sized to fit within the pin openings on each bracket arm, all of the pin openings on each bracket arm being arranged in a single line next to one another and at least one of the pin openings on each bracket arm being positioned farther forward and higher than an adjacent pin opening.

16. The outboard motor as set forth in claim 15, wherein each single line, along which the pin holes are arranged, extends in an arc having a substantially constant radius of curvature.

17. The outboard motor as set forth in claim 15, wherein each one of the bracket arms defines an outer surface with an edge that has a similar shape to the corresponding single line along which the pin holes are arranged.

18. The outboard motor as set forth in claim 15 additionally comprising a steering shaft defining the steering axis, a rear end of each bracket arm being positioned farther forward than the steering axis.

* * * * *